US008091188B1

(12) United States Patent
Maga

(10) Patent No.: US 8,091,188 B1
(45) Date of Patent: Jan. 10, 2012

(54) FOOTWEAR EYELET MANUFACTURING APPARATUS AND METHOD OF USE THEREOF

(76) Inventor: Militina Maga, Molalla, OR (US)

( * ) Notice: Subject to any disclaimer, the term of this patent is extended or adjusted under 35 U.S.C. 154(b) by 1072 days.

(21) Appl. No.: 11/978,485

(22) Filed: Oct. 29, 2007

(51) Int. Cl.
*A43D 5/00* (2006.01)

(52) U.S. Cl. ..... 24/575.1; 12/113; 12/142 LC

(58) Field of Classification Search ..... 12/113, 12/142 LC; 24/712.4, 713.1, DIG. 31, DIG. 37, 24/575.1; 29/271
See application file for complete search history.

(56) References Cited

U.S. PATENT DOCUMENTS 760,385 A * 5/1904 Donovan et al. ..... 12/113
846,252 A * 3/1907 Sharood ..... 12/113
930,426 A * 8/1909 Smith ..... 12/113
1,161,871 A * 11/1915 Lewis ..... 12/142 LC
4,207,824 A 6/1980 Swift
4,296,515 A * 10/1981 Hauser ..... 12/142 LC
4,363,253 A 12/1982 Cantella
4,418,595 A 12/1983 Cantella
4,544,519 A 10/1985 Schilke
4,555,823 A 12/1985 Pedretti et al.
4,691,398 A 9/1987 Kadogawa et al.
5,271,117 A 12/1993 Vale et al.
5,438,724 A 8/1995 Merser
5,515,697 A 5/1996 Chen
5,678,269 A 10/1997 Walega

* cited by examiner

*Primary Examiner* — James Brittain
(74) *Attorney, Agent, or Firm* — Montgomery Patent & Design, LLC; Robert C. Montgomery; Joseph T. Yaksich

(57) ABSTRACT

The invention as presently conceived discloses an apparatus to aid in holding shoe eyelets in place during the shoe manufacturing process. The apparatus has a large comb shape with a plurality of rod shaped teeth corresponding to the number of shoe eyelet pairs. In operation, each tooth that is threaded through a shoe eyelet pair comprises "eyes" on each end similar to those found on sewing needles. A pair of metal or plastic rods, equipped with locking features, is then threaded through the eyes to secure the apparatus with the shoe eyelet in place. There are various sizes of the apparatus to accommodate different sized shoes and number of shoe eyelet pairs. The use of this apparatus saves time in the manufacturing process while improving work quality and increasing operator safety.

15 Claims, 3 Drawing Sheets

FOOTWEAR EYELET MANUFACTURING APPARATUS AND METHOD OF USE THEREOF

RELATED APPLICATIONS

The present invention was first described in and claims the benefit of Disclosure Document No. 609,168 on Nov. 16, 2006.

FIELD OF THE INVENTION

This invention relates to implements used during a shoe-manufacturing process and, more particularly, to an apparatus for holding shoe eyelets in place during the shoe manufacturing process.

BACKGROUND OF THE INVENTION

As anyone who performs a lot of physical work will attest, nothing beats having the proper tool for a job. The proper tool can save time, save money, produce a higher quality job, reduce damage to equipment, and provide for the increased safety of the worker. Each field of physical work has its own type of specialty tools, each performing a specialized task. The field of shoe manufacturing is no different. One aspect of shoe construction most people are not aware of is that it is sometimes necessary to hold the lace eyelet area of the shoe together. This is currently accomplished by retainers which are prone to breakage, thus requiring rework.

Several attempts have been made in the past to design an effective apparatus for holding shoe eyelets in place during the shoe manufacturing process. U.S. Pat. No. 4,207,824 in the name of Swift discloses a method of and machine for stitching a thong to an upper in a machine for the manufacture of footwear in which the vamp is sewn to the upper by leather thongs, in which a barbed needle on a ram reciprocating in a fluid operated cylinder is passed through preformed pairs of shaped holes in the material to be thonged, applying a thonging thread to the needle and applying fluid to one end of the cylinder to draw the needle and the thonging thread through the vamp and the upper, withdrawing the needle and moving the material to receive the needle through a succeeding pair of holes on the material and applying fluid to the opposite end side of the ram and re-passing the needle and thonging thread through the vamp and upper for succeeding stitches, an air line being connected to each end of the cylinder with a control valve to regulate the air flow. Unfortunately, this prior art example is not designed for holding the eyelet area together.

U.S. Pat. No. 4,363,253 in the name of Cantella discloses an automatic hollow punch search device and relevant control, for die-cutting machines, particularly for footwear production, in which a mobile head is associated to means to move it to and fro, both horizontally and vertically, above a fixed faceplate on which the material to be cut is placed, together with a hollow cutting punch. The movement means are automatically piloted by a drive circuit interlocked to manual starting means which provides means to carry out a complete head movement operating sequence from its positioning above the hollow punch to its lowering and return to the starting point after cutting. Unfortunately, this prior art example is not designed to correspond with varying shoe sizes.

U.S. Pat. No. 4,418,595 in the name of Cantella discloses a method for operating an automatic hollow punch search device and relevant control, for die-cutting machines, particularly for footwear production, in which a mobile head is associated to a device to move it to and fro, both horizontally and vertically, above a fixed faceplate on which the material to be cut is placed, together with a hollow cutting punch. The movement devices are automatically piloted by a drive circuit interlocked to a manual starting device which provides means to carry out a complete head movement operating sequence from its positioning above the hollow punch to its lowering and return to the starting point after cutting. Unfortunately, this prior art example is not designed for holding an eyelet area together.

None of the prior art particularly describes an apparatus for holding shoe eyelets in place during the shoe manufacturing process. Accordingly, there is a need for a means by which the eyelet areas of shoes can be retained together in a manner that not only allows for quick retention, but is not prone to easy breakage. The present invention is convenient and easy to use, lightweight yet durable in design, and designed for many years of repeated use.

SUMMARY OF THE INVENTION

In view of the foregoing disadvantages inherent in the prior art, it has been observed that there is need for an apparatus for holding shoe eyelets in place during the shoe manufacturing process.

The present invention is an apparatus to aid in holding shoe eyelets in place during the shoe manufacturing process. The invention takes the form of a large comb shape apparatus with the number of teeth corresponding to the number of eyelet pairs on a shoe. Each tooth that is threaded through an eyelet pair is provided with an "eye" on its end in much the same manner as a needle. A metal or plastic loop resembling a hair pin or bobby pin is then threaded through the eyes to secure the invention and the shoe eyelet in place. To remove the invention, the loop is simply pulled up and the comb like structure slid out. The invention would be made available in varying sizes to suit different sized shoe and number of eyelet pairs. Such a selection of sizes is envisioned to be anywhere from three (3) to eight (8) or more on standard shoe sizes. The use of the present apparatus allows for the quick manufacture of laced footwear in a manner which is quick, easy and effective.

A shoe aligning implement includes an alignment jig including a plurality of rigid alignment guides effectively passed through corresponding shoe holes formed at an upper portion of a shoe. Each of such alignment guides has a plurality of first end rings formed at a first end thereof, and each of the alignment guides further has a plurality of second end rings disposed at a second end thereof. Such first and second end rings are disposed laterally and outwardly of corresponding shoe-string holes formed in the upper portion of the shoe. The second end rings are conveniently provided with a "D"-shaped inner opening slidingly attached over and around a common header to thereby control a radial position of the second end rings at the upper portion of the shoe. Also, each of the alignment guides has a circular cross-section formed along a rectilinear medial portion thereof for reducing a likelihood of deforming the shoe-string holes during repeated insertion and removal therefrom.

The implement further includes a flexible retaining clip positioned through each of the first end rings respectively. Such a retaining clip includes a latching spring loop formed at an end thereof. Such a latching spring loop is releasably engaged with an opposite end of the retaining clip in such a manner that the opposite end is statically affixed to the latching spring loop during the manufacturing process and thereby prohibits the first end rings from disengaging the retaining clip. The retaining clip is advantageously provided with a longitudinal length approximately equal to a longitudinal length of the common header, and further includes a first substantially rectilinear segment extending along an entire longitudinal length of the retaining clip. The latching spring loop is disposed at an end of the first segment, and a second substantially rectilinear segment is monolithically formed with the first segment and has an end seated within the latching spring loop during a locked position.

The implement further includes a rigid rectilinear common header slidably penetrated through each of the second end rings respectively and spaced from the retaining clip. Also, a retaining cap is removably attached directly to one end of the common header such that the alignment guides are effectively prohibited from separating from the common header.

A method for keeping an upper portions of a shoe in a position similar to that of laced shoes to thereby prevent the laced upper portions from flailing about and ultimately becoming jammed during a shoe-manufacturing process includes the steps of: passing a plurality of rigid alignment guides through corresponding shoe holes formed at an upper portion of a shoe; laterally and outwardly disposing first and second end rings of the alignment guides through of corresponding shoe-string holes formed in the upper portion of the shoe; positioning a flexible retaining clip positioned through each of the first end rings respectively; slidably penetrating a rigid rectilinear common header through each of the second end rings respectively by spacing the common header from the retaining clip; and removably attaching a retaining cap directly to one end of the common header such that the alignment guides are prohibited from separating from the common header.

The method further includes the steps of: passing the first end rings through corresponding eyelet holes formed at a left side of the upper shoe portion; passing the second end rings through corresponding eyelet holes formed at a right side of the upper shoe portion; and inserting the retaining clip corresponding ones of the first end rings located on an end of the alignment guides.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
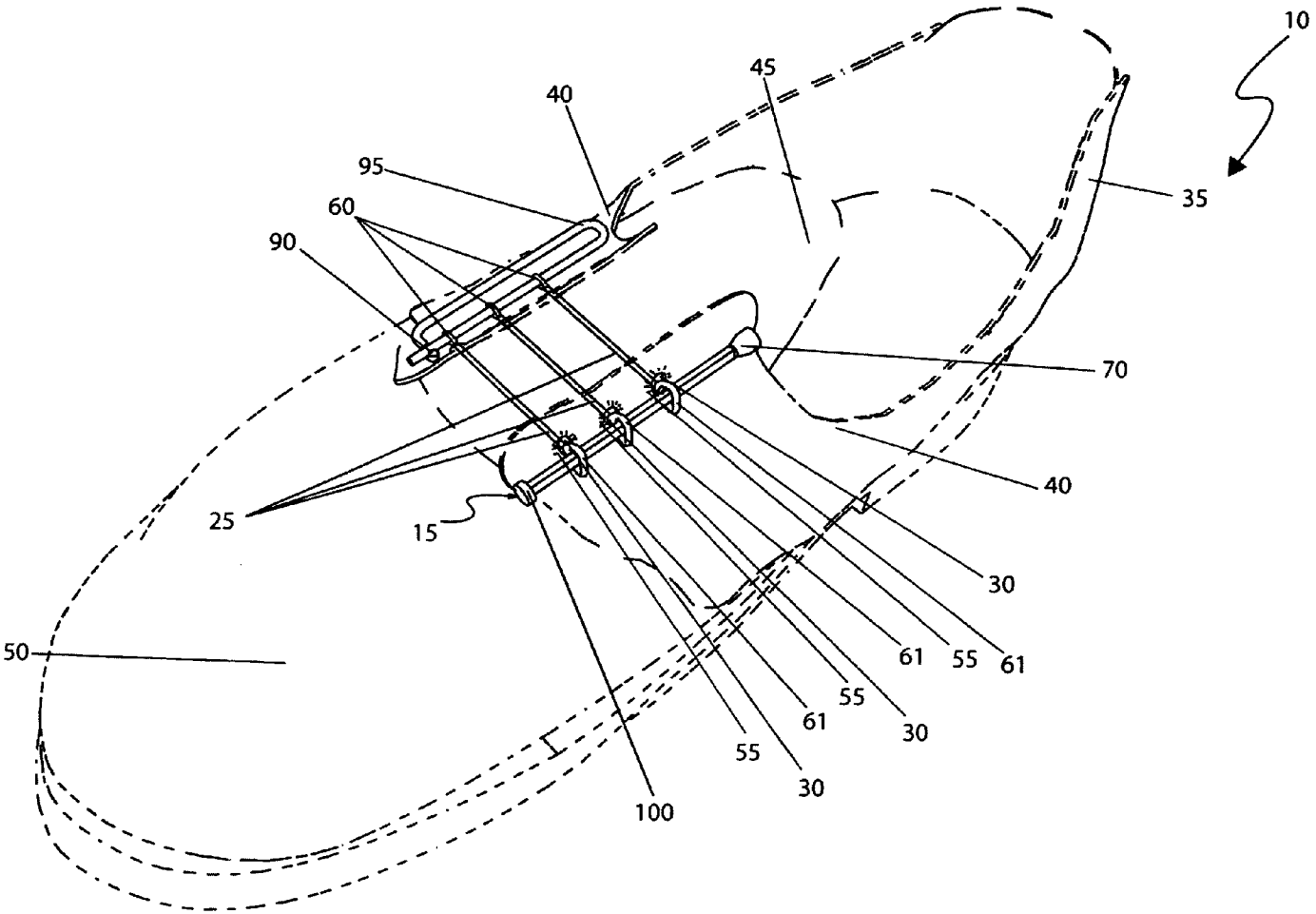
FIG. 1 is an overall perspective diagram of the eyelet footwear manufacturing aid 10, shown in an utilized state, according to the preferred embodiment of the present invention.

10 eyelet footwear manufacturing aid
15 eyelet array alignment jig
20 retaining clip
25 parallel alignment guides
30 eyelet holes
35 shoe
40 laced uppers
45 shoe tongue
50 vamp
55 eyelet reinforcement holes
60 first end ring
61 second end ring
65 retaining means
70 common header
75 overall diameter "d"
80 first overall length "$l^1$"
85 second overall length "$l^2$"
90 hooking feature
95 spring loop
100 retaining cap

DETAILED DESCRIPTION OF THE PREFERRED EMBODIMENT

Figure 2:
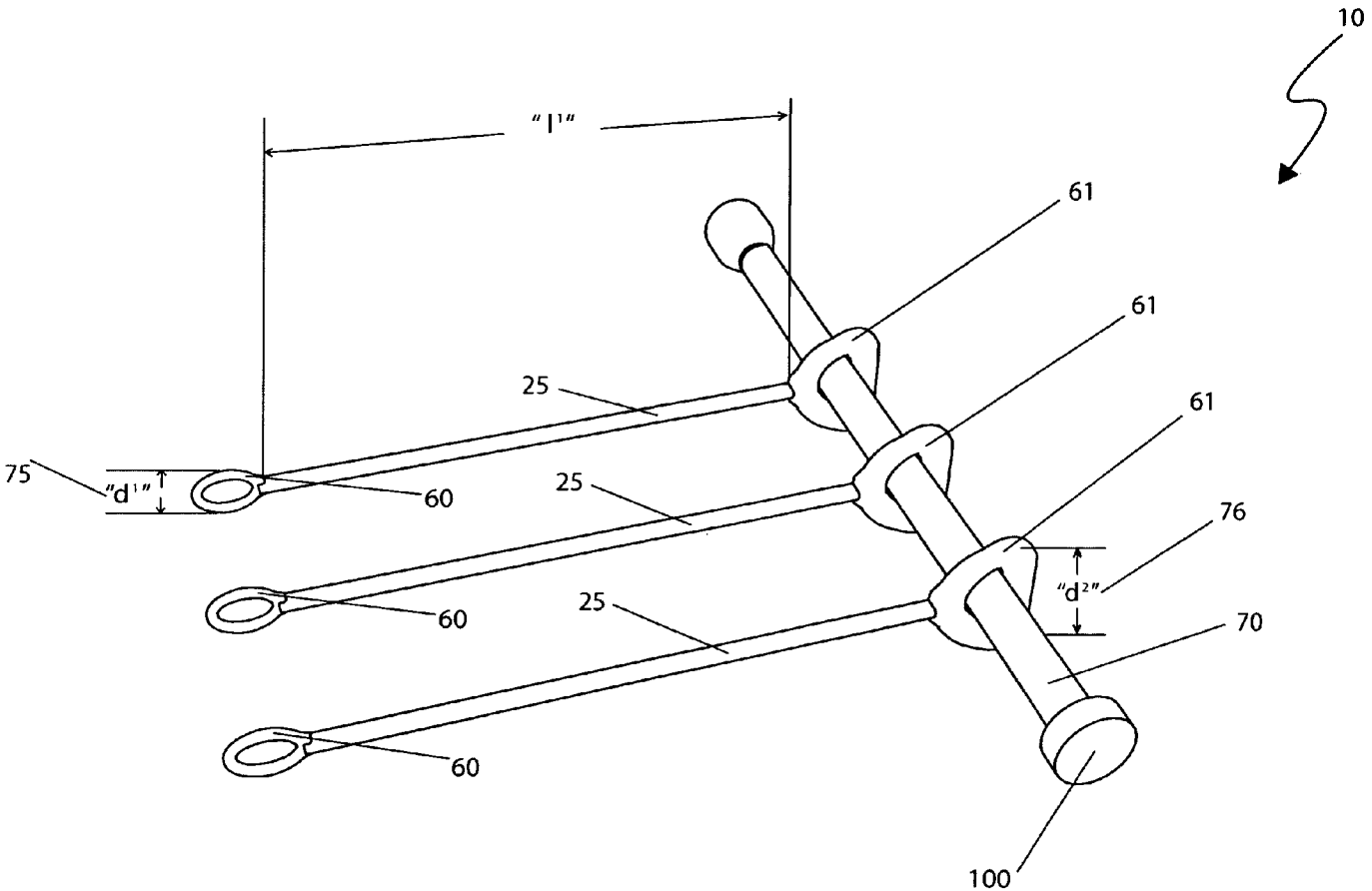
FIG. 2 is a front view of the eyelet array alignment jig 15 as used with the eyelet footwear manufacturing aid 10; and, FIG. 3 is a front view of the retaining clip 20 as used with the eyelet footwear manufacturing aid 10.
Figure 3:
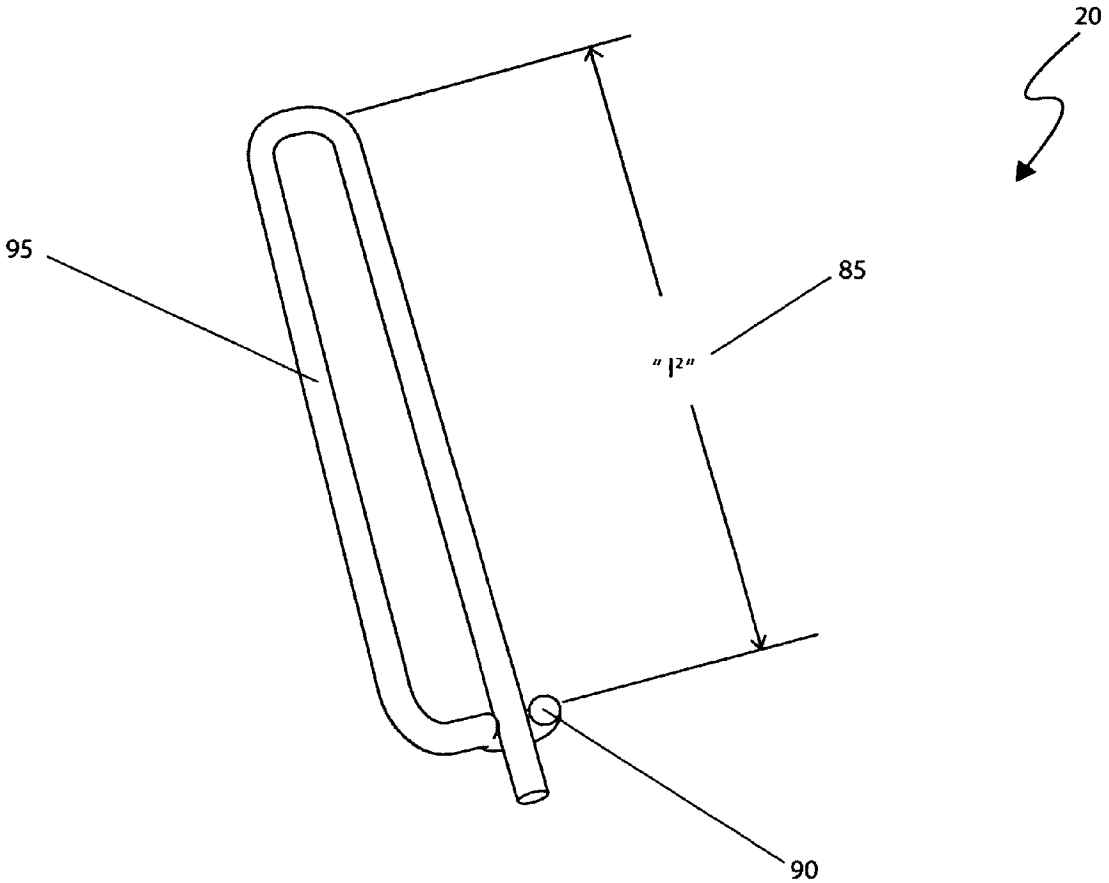

The best mode for carrying out the invention is presented in terms of its preferred embodiment, herein depicted within FIGS. 1 through 3. However, the invention is not limited to the described embodiment and a person skilled in the art will appreciate that many other embodiments of the invention are possible without deviating from the basic concept of the invention, and that any such work around will also fall under scope of this invention. It is envisioned that other styles and configurations of the present invention can be easily incorporated into the teachings of the present invention, and only one particular configuration shall be shown and described for purposes of clarity and disclosure and not by way of limitation of scope.

The terms "a" and "an" herein do not denote a limitation of quantity, but rather denote the presence of at least one of the referenced items.

Referring now to FIG. 1, an overall perspective diagram of the eyelet footwear manufacturing aid 10, shown in a utilized state, according to the preferred embodiment of the present invention is disclosed. The eyelet footwear manufacturing aid 10 consists of two major components, the eyelet array alignment jig 15 and the retaining clip 20. The eyelet array alignment jig 15 consists of a series of parallel alignment guides 25 that are inserted through an array of eyelet holes 30 on both the left and right side of a shoe 35 in the area of laced uppers 40. The laced uppers 40 along with a shoe tongue 45 are joined together at a vamp 50, or toe area, of the shoe 35. In a typical manufacturing process, a series of eyelet reinforcement holes 55 are installed in the laced uppers 40 as shown. During the remaining manufacturing process, it is necessary to keep the laced uppers 40 in a position similar to that of laced shoes and to avoid the laced uppers 40 from flailing about, becoming jammed in additional assembly machinery, contacting adhesive or vinyl application areas or the like. Such positioning has typically been provided by individual restraining devices that coupled one eyelet hole 30 and one eyelet reinforcement hole 55 on one side of the laced uppers 40 to a corresponding eyelet hole 30 and eyelet reinforcement hole 55 on the opposite laced uppers 40. Generally, such previous restraining devices are single devices thus requiring multiple devices corresponding to the number of eyelet holes 30 on one side of the laced uppers 40.

Additionally, such restraining devices were of low quality and thus prone to breakage and excessive replacement costs. The eyelet footwear manufacturing aid 10 uses one eyelet array alignment jig 15 with a corresponding number of parallel alignment guides 25 in place of the previous individual restraining devices. Once fully inserted, the user then inserts the retaining clip 20 through a corresponding series of first end rings 60 located on the end of the parallel alignment guides 25 as shown. In this manner the eyelet array alignment jig 15 and the retaining clip 20 act as one unit to align the laced uppers 40 and retrain them in a laced, closed and restrained position during the rest of manufacturing. After all manufacturing and assembly processes are complete, the retaining clip 20 is removed, the eyelet array alignment jig 15 slid out, and a conventional shoe lace is inserted in the normal, customary and expected manner, thus allowing the shoe to be completed and ready for sale. The retaining clip 20 comprises a latching spring loop to enable easy opening and closing in a similar manner to a safety pin, thereby allowing insertion through said parallel alignment guides 25 and latching to allow self retention.

Referring next to FIG. 2, a front view of the eyelet array alignment jig 15 as used with the eyelet footwear manufacturing aid 10 is shown. The eyelet array alignment jig 15 consists of a plurality of parallel alignment guides 25, a common header 70, and a retaining cap 100. It is envisioned that the individual portions of said eyelet array alignment jig 15 are made of durable metal or plastic materials suitable to a manufacturing environment. It is also envisioned that the series of parallel alignment guides 25 are of a circular cross section to aid in insertion and removal without negatively affecting the aesthetic quality of the shoe. As aforementioned described, the quantity of parallel alignment guides 25 is illustrated in a group of three (3); however, any number may be used at the user's discretion. As such, the quantity of parallel alignment guides 25 should not be interpreted as a limiting factor of the present invention. Located at a proximal end of said parallel alignment guides 25 is a first end ring 60 provided at an overall diameter "$d^1$" 75 such that it will fit within the eyelet reinforcement holes 55, the eyelet holes 30, and subsequently over the retaining clip 20.

In an equal manner, each parallel alignment guide 25 is provided at a first overall length "$l^1$" 80. Such a first overall length "$l^1$" 80 is envisioned to vary for each type and each style of shoe being manufactured. Finally, located at a distal end of said parallel alignment guide 25 is a second end ring 61 provided at an overall diameter "$d^2$" 76 such that it will fit within the eyelet reinforcement holes 55 and the eyelet holes 30. Said second end ring 61 further comprises a "D"-shaped inner opening which slidingly attaches over and around the common header 70 which in turn provides a companion "D"-shaped cross-section, thereby controlling a radial position of the second end ring 61. Such information regarding the specific use of each eyelet array alignment jig 15 could be stamped on the common header 70 to aid in the manufacturing process. The retaining cap 100 is envisioned to be a plastic female cylindrical device providing a friction-fit connection thereupon an end of said common header 70, thereby retaining and securing said parallel alignment guides 25 thereupon the common header 70.

Referring finally now to FIG. 3, a front view of the retaining clip 20 as used with the eyelet footwear manufacturing aid 10 is depicted. Each retaining clip 20 is provided with a second overall length "$l^2$" 85, approximately equal in length to that of the common header 70 (as shown in FIG. 2). The retaining clip 20 is provided with a spring loop 95 to provide the self-closing and retaining characteristics of the retaining clip 20. The retaining clip 20 is also provided with a hooking feature 90 to aid in the latching and securing of said retaining clip 20 therein the first end rings 60 (as shown in FIG. 2).

It is envisioned that other styles and configurations of the present invention can be easily incorporated into the teachings of the present invention, and only one particular configuration shall be shown and described for purposes of clarity and disclosure and not by way of limitation of scope.

The preferred embodiment of the present invention can be utilized by the common user in a simple and effortless manner with little or no training. As anyone who performs a lot of physical work will attest, nothing beats having the proper tool for a job. The proper tool can save time, save money, produce a higher quality job, reduce damage to equipment, and provide for the increased safety of the worker. Each field of physical work has its own type of specialty tools, each performing a specialized task. The field of shoe manufacturing is no different. One aspect of shoe construction most people are not aware of is that it is sometimes necessary to hold the lace eyelet area of the shoe together. This is currently accomplished by retainers which are prone to breakage, thus requiring rework. Accordingly, there is a need for a means by which the eyelet areas of shoes can be retained together in a manner that not only allows for quick retention, but is not prone to easy breakage. The development of the present invention fulfills this need.

It is envisioned that the eyelet footwear manufacturing aid 10 would be obtained in bulk for usage in production line shoe assembly facilities. The eyelet footwear manufacturing aid 10 would comprise the eyelet array alignment jig 15 and the retaining clip 20. An appropriate eyelet array alignment jig 15 and retaining clip 20 would be selected during the appropriate time during the shoe manufacturing process to hold the laced uppers 40 together as described herein above. The parallel alignment guides 25 would be inserted through the eyelet holes 30 with or without the shoe 35 to aid in the retaining of the eyelet array alignment jig 15. After additional manufacturing processes are completed, and the functionality of the eyelet footwear manufacturing aid 10 is no longer required, it would be removed and made available for reuse with following shoes in the manufacturing process.

The foregoing descriptions of specific embodiments of the present invention have been presented for purposes of illustration and description. They are not intended to be exhaustive or to limit the invention and method of use to the precise forms disclosed. Obviously many modifications and variations are possible in light of the above teaching. The embodiment was chosen and described in order to best explain the principles of the invention and its practical application, and to thereby enable others skilled in the art to best utilize the invention and various embodiments with various modifications as are suited to the particular use contemplated. It is understood that various omissions or substitutions of equivalents are contemplated as circumstance may suggest or render expedient, but is intended to cover the application or implementation without departing from the spirit or scope of the claims of the present invention.

What is claimed is:

1. A shoe aligning implement for holding shoe eyelets at a desired position during a manufacturing process, said shoe aligning implement comprising:

an alignment jig including a plurality of alignment guides passed through corresponding shoe holes formed at an upper portion of a shoe, each of said alignment guides having a plurality of first end rings formed at a first end thereof, each of said alignment guides further having a plurality of second end rings disposed at a second end thereof, said first and second end rings being disposed laterally and outwardly of corresponding shoe-string holes formed in the upper portion of the shoe;

a retaining clip positioned through each of said first end rings respectively;

a rectilinear common header slidably penetrated through each of said second end rings respectively; and, a retaining cap removably attached directly to one end of said common header such that said alignment guides are prohibited from separating from said common header.

2. The shoe aligning implement of claim 1, wherein said retaining clip comprises: a latching spring loop formed at an end thereof, said latching spring loop being releasably engaged with an opposite end of said retaining clip in such a manner that said opposite end is statically affixed to said latching spring loop during the manufacturing process and thereby prohibits said first end rings from disengaging said retaining clip.

3. The shoe aligning implement of claim 2, wherein said retaining clip further comprises:

a first substantially rectilinear segment extending along an entire longitudinal length of said retaining clip, said latching spring loop being disposed at an end of said first segment; and, a second substantially rectilinear segment monolithically formed with said first segment and having an end seated within said latching spring loop during a locked position.

4. The shoe aligning implement of claim 1, wherein each of said alignment guides have a circular cross section formed along a rectilinear medial portion thereof for reducing a likelihood of deforming the shoe-string holes during repeated insertion and removal therefrom.

5. The shoe aligning implement of claim 1, wherein said second end rings are provided with a "D"-shaped inner opening slidingly attached over and around a common header to thereby control a radial position of said second end rings at the upper portion of the shoe.

6. The shoe aligning implement of claim 1, wherein said retaining clip is provided with a longitudinal length approximately equal to a longitudinal length of said common header.

7. A shoe aligning implement for holding shoe eyelets at a desired position during a manufacturing process, said shoe aligning implement comprising:

an alignment jig including a plurality of rigid alignment guides passed through corresponding shoe holes formed at an upper portion of a shoe, each of said alignment guides having a plurality of first end rings formed at a first end thereof, each of said alignment guides further having a plurality of second end rings disposed at a second end thereof, said first and second end rings being disposed laterally and outwardly of corresponding shoe-string holes formed in the upper portion of the shoe;

a flexible retaining clip positioned through each of said first end rings respectively;

a rigid rectilinear common header slidably penetrated through each of said second end rings respectively and spaced from said retaining clip; and, a retaining cap removably attached directly to one end of said common header such that said alignment guides are prohibited from separating from said common header.

8. The shoe aligning implement of claim 7, wherein said retaining clip comprises: a latching spring loop formed at an end thereof, said latching spring loop being releasably engaged with an opposite end of said retaining clip in such a manner that said opposite end is statically affixed to said latching spring loop during the manufacturing process and thereby prohibits said first end rings from disengaging said retaining clip.

9. The shoe aligning implement of claim 8, wherein said retaining clip further comprises:

a first substantially rectilinear segment extending along an entire longitudinal length of said retaining clip, said latching spring loop being disposed at an end of said first segment; and, a second substantially rectilinear segment monolithically formed with said first segment and having an end seated within said latching spring loop during a locked position.

10. The shoe aligning implement of claim 7, wherein each of said alignment guides have a circular cross section formed along a rectilinear medial portion thereof for reducing a likelihood of deforming the shoe-string holes during repeated insertion and removal therefrom.

11. The shoe aligning implement of claim 7, wherein said second end rings are provided with a "D"-shaped inner opening slidingly attached over and around a common header to thereby control a radial position of said second end rings at the upper portion of the shoe.

12. The shoe aligning implement of claim 7, wherein said retaining clip is provided with a longitudinal length approximately equal to a longitudinal length of said common header.

13. A method for keeping an upper portions of a shoe in a position similar to that of laced shoes to thereby prevent the laced upper portions from flailing about and ultimately becoming jammed during a shoe-manufacturing process, said method comprising the steps of:

a. passing a plurality of rigid alignment guides through corresponding shoe holes formed at an upper portion of a shoe;

b. laterally and outwardly disposing first and second end rings of said alignment guides through of corresponding shoe-string holes formed in the upper portion of the shoe;

c. positioning a flexible retaining clip positioned through each of said first end rings respectively;

d. slidably penetrating a rigid rectilinear common header through each of said second end rings respectively by spacing said common header from said retaining clip; and, e. removably attaching a retaining cap directly to one end of said common header such that said alignment guides are prohibited from separating from said common header.

14. The method of claim 13, further comprising:

passing said first end rings through corresponding eyelet holes formed at a left side of the upper shoe portion; and, passing said second end rings through corresponding eyelet holes formed at a right side of the upper shoe portion.

15. The method of claim 13, further comprising:

inserting said retaining clip corresponding ones of said first end rings located on an end of said alignment guides.

* * * * *